US012096831B1

(12) United States Patent
Collins

(10) Patent No.: US 12,096,831 B1
(45) Date of Patent: Sep. 24, 2024

(54) CONVERTIBLE PICNIC BASKET

(71) Applicant: 7C LLC, New Preston Marble Dale, CT (US)

(72) Inventor: Alicia Collins, New Preston Marble Dale, CT (US)

( * ) Notice: Subject to any disclaimer, the term of this patent is extended or adjusted under 35 U.S.C. 154(b) by 0 days.

(21) Appl. No.: 18/658,603

(22) Filed: May 8, 2024

(51) Int. Cl.

| | |
|---|---|
| ***A45C 9/00*** | (2006.01) |
| ***A45C 7/00*** | (2006.01) |
| ***A45C 11/20*** | (2006.01) |
| ***A47G 9/06*** | (2006.01) |
| *A45F 4/02* | (2006.01) |
| *B65D 5/42* | (2006.01) |

(52) U.S. Cl.
CPC ..... *A45C 11/20* (2013.01); *A45C 9/00* (2013.01); *A47G 9/062* (2013.01); *A45C 2007/0004* (2013.01); *A45C 7/0095* (2013.01); *A45F 4/02* (2013.01); *B65D 5/4287* (2013.01)

(58) Field of Classification Search
CPC ..... A45C 3/10; A45C 7/0095; A45C 7/0077; A45C 7/0036; A45C 7/0054; A45C 9/00; A45C 9/062; A45C 11/20; A45C 2007/0004; A45C 2009/007; A45F 3/46; A45F 4/02; A47G 9/062; A47G 11/003; B65D 5/4287
USPC ..... 190/107, 1; 206/541, 546; 224/577; 220/103; 383/4; 5/417, 420
See application file for complete search history.

(56) References Cited

U.S. PATENT DOCUMENTS 751,190 A * 2/1904 Martin ..... A45C 9/00 224/156
D117,833 S * 11/1939 Laine ..... D9/423
2,295,508 A * 9/1942 Altheimer ..... B65D 5/247 229/151
2,344,010 A * 3/1944 Walsh ..... A47G 9/064 5/418
2,514,073 A * 7/1950 Karlson ..... B65D 5/36 229/126
2,831,624 A * 4/1958 Lever ..... B65D 5/4287 383/122
3,097,782 A * 7/1963 Koropatkin ..... A45C 9/00 229/189
3,477,552 A * 11/1969 Goldman ..... A47C 17/82 5/413 R
3,976,113 A * 8/1976 Kim ..... A45C 9/00 383/4
4,188,988 A * 2/1980 Agyagos ..... A45C 3/00 383/18
4,197,891 A * 4/1980 Comollo ..... A45C 9/00 383/18

(Continued)

FOREIGN PATENT DOCUMENTS

JP 3090830 U * 12/2002 ..... A45C 7/00

*Primary Examiner* — Gideon R Weinerth
(74) *Attorney, Agent, or Firm* — RC Trademark Company

(57) ABSTRACT

According to some embodiments, a basket that converts to a picnic mat is disclosed. The picnic basket includes a planar material comprised of equally sized panels arranged in a three-row by six-column configuration and a support strap system. The support strap system is disposed across a column next to a first edge column wherein the support strap system is centered between the first pocket and the second pocket by folding the column three columns from the first edge column and two columns from the second edge column over the column next to a first edge column.

5 Claims, 5 Drawing Sheets

(56) References Cited

U.S. PATENT DOCUMENTS 4,337,812 A * 7/1982 Trinkner ..... A45F 4/02 206/541
4,375,111 A * 3/1983 Hall ..... A45C 9/00 383/3
4,468,810 A * 8/1984 Longo ..... A45C 9/00 383/3
4,489,815 A * 12/1984 Martinez ..... A45F 4/02 229/189
4,499,999 A * 2/1985 Behar ..... A45C 9/00 206/541
4,738,545 A * 4/1988 Westgor ..... A45C 3/10 472/137
4,984,906 A * 1/1991 Little ..... A45C 9/00 383/110
5,048,975 A * 9/1991 Holbrook ..... A45F 4/02 383/4
5,103,515 A * 4/1992 Bird ..... A45C 9/00 5/420
5,328,265 A * 7/1994 Clooney ..... A47G 11/001 383/122
6,059,179 A * 5/2000 Giampapa ..... A45C 15/00 229/117.15
6,276,828 B1 * 8/2001 Otley ..... A45C 9/00 383/18
7,188,713 B1 * 3/2007 Espar ..... A45F 4/06 383/4
7,597,209 B2 * 10/2009 Rothschild ..... A45C 15/00 220/6
7,798,323 B1 * 9/2010 McCann ..... A61F 17/00 206/370
D962,641 S * 9/2022 Wei ..... D3/290
11,576,511 B2 * 2/2023 Patel ..... A45F 3/14
2005/0005355 A1 * 1/2005 Marks ..... A47G 9/062 5/417
2005/0056643 A1 * 3/2005 Hagan ..... A45C 7/0077 220/9.3
2006/0177154 A1 * 8/2006 Morrissey ..... A47G 9/062 383/4
2009/0321503 A1 * 12/2009 Barnes ..... B65D 81/36 229/103
2012/0233772 A1 * 9/2012 Wang ..... A63B 21/4037 5/417
2013/0319903 A1 * 12/2013 Floyd-Vester ..... A45C 7/00 206/546
2016/0242519 A1 * 8/2016 Calman ..... A45C 9/00
2018/0242703 A1 * 8/2018 Singh ..... A45C 7/0077
2020/0315384 A1 * 10/2020 Patel ..... A45C 9/00
2021/0361043 A1 * 11/2021 Wood ..... A45C 7/0077
2023/0124853 A1 * 4/2023 Stein ..... A45F 4/02 224/153

* cited by examiner

CONVERTIBLE PICNIC BASKET

BACKGROUND

A picnic basket or picnic hamper is a basket intended to hold food and tableware for a picnic meal. Picnic baskets are standard equipment at many picnics along with a blanket or mat for the participants to sit. Convertible picnic baskets are picnic baskets that convert to a surface for eating but are very small and the convertible baskets tend to be flimsy. Therefore, a convertible basket that provides a larger surface area for eating with added strength is desirable.

SUMMARY

Some embodiments described herein relate to a basket that converts to a picnic mat. The convertible picnic basket includes a planar material comprised of equally sized panels arranged in a three-row by six-column configuration and a support strap system. The support strap system is disposed across a column next to a first edge column wherein the support strap system is centered between the first pocket and the second pocket by folding the column three columns from the first edge column and two columns from the second edge column over the column next to a first edge column.

DETAILED DESCRIPTION

In the following detailed description, numerous specific details are set forth in order to provide a thorough understanding of the embodiments. However, it will be understood by those of ordinary skill in the art that the embodiments may be practiced without these specific details. In other instances, well-known methods, procedures and components have not been described in detail so as not to obscure the embodiments.

Figure 1:
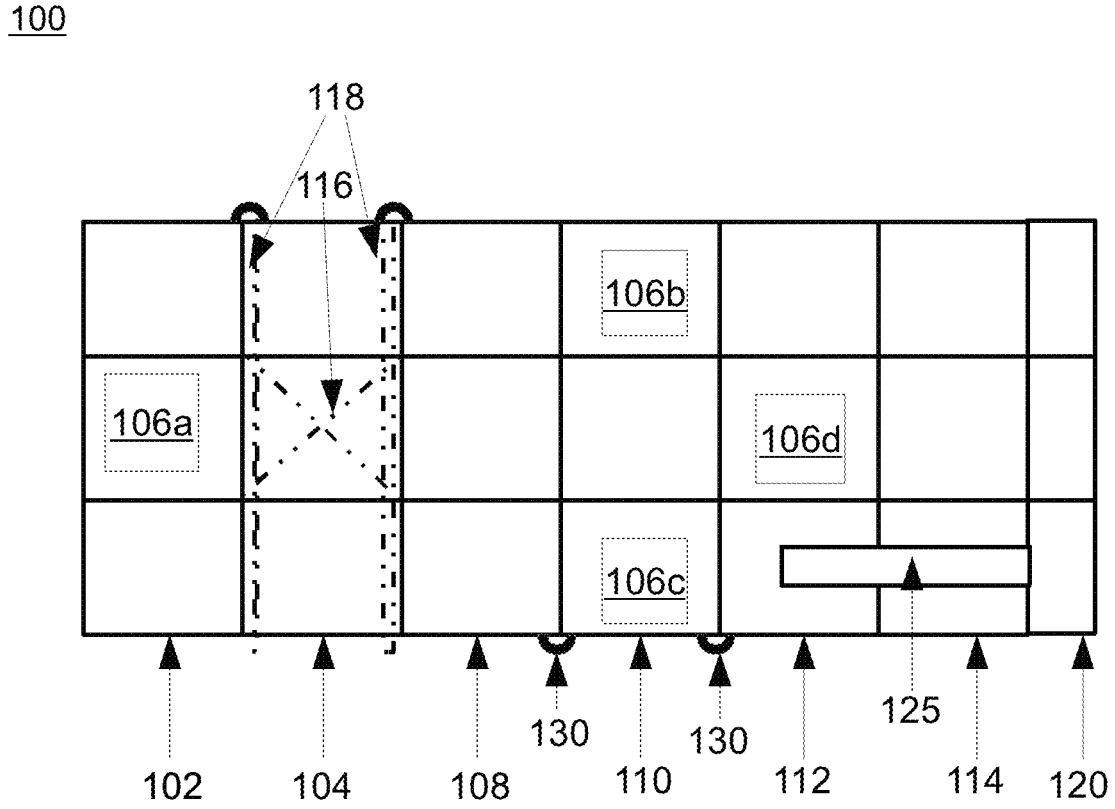
FIG. 1 illustrates a convertible picnic basket in accordance with some embodiments.

Now referring to FIG. 1, a convertible picnic basket 100 is illustrated. The convertible picnic basket 100 is illustrated in a planar configuration (e.g., an unfolded configuration) for use as a picnic mat. However, as will be shown, the planar configuration (e.g., picnic mat) may be converted to a picnic basket (e.g., a folded configuration) as explained in more detail below. The picnic basket may be comprised of a planar material that is comprised of panels arranged in row by column configuration. For example, the picnic basket may be comprised of denim, canvas, a flexible or hinged plastic, or any other material that may be folded and unfolded to convert from a picnic mat configuration to a picnic basket configuration.

A first edge column is illustrated at 102. A support strap system 116/118 is disposed across a column 104 that is next to the first edge column 102. The support strap system

116/118 comprises straps 118 and an X bracing portion 116. The support strap system 116/118, in some embodiments, may be removably coupled. For example, the support strap system 116/118 may be affixed to the panels via a hook and loop fastener (e.g., Velcro™) or by snap connectors. This way, the support strap system 116/118 may be removed when in an unfolded configuration.

As illustrated in FIG. 1, the convertible picnic basket 100 may comprise 18 regular panels and a row of three lid panels 120 and each of the 18 regular panels may be equally sized and may be in a three-row by six-column configuration. The row of three lid panels 120 may be comprised of three panels and each of the three panels may be rectangular in shape and smaller than a respective regular panel. When in a folded configuration, the regular panels may be connected to form a basket via fasteners such as, but not limited to, a hook and loop fastener (e.g., Velcro™) or by snap connectors. The three lid panels 120 may be disposed at one end of the convertible picnic basket 100 in a flat configuration and may function as part of a lid for the picnic basket when in a folded configuration. In some embodiments, the convertible picnic basket 100 may further comprise a strap 125 and loops 130. The strap 125 when in a folded configuration hangs down a front of the convertible picnic basket 100 to facilitate opening the lid of the convertible picnic basket 100. The loops 130 may facilitate carrying the convertible picnic basket 100 by straps (not shown)

When configured as a basket (e.g., a folded configuration), a plurality of pockets 106*a*/106*b*/106*c*/106*d* may be oriented toward an inside of the basket 100. To accomplish the pockets 106*a*/106*b*/106*c*/106*d* being oriented toward an inside of the basket, a first pocket 106*a* may be disposed on the first edge column 102. In particular, the first pocket 106*a* is disposed on a middle panel of the first edge column 102. A second pocket 106*d* is disposed on a column 112 that is one column away from a second edge column 114 and, in particular, the second pocket 106*d* is disposed on a middle panel of column 113. In some embodiments, a column 110 that is three columns from the first edge column 102 and two columns from the second edge column 114 comprises a third pocket 106*b*. In some embodiments, the column 110 three columns from the first edge column 102 and two columns from the second edge column 114 comprises a fourth pocket 106*c*. In an embodiment when the picnic basket comprises a third pocket 106*b* and a fourth pocket 106*c*, one of the eighteen regular panels is disposed between a panel comprising the third pocket 106*b* and a panel comprising the fourth pocket 106*c*. In other words, a blank panel is between the third pocket 106*b* and the fourth pocket 106*c*. To cover the picnic basket, a lid is employed and the second edge column 114, when folded, functions as the lid for the convertible picnic basket 100. The second edge column 114 may be disposed adjacent to the 3 lid panels 120.

Referring now to FIG. 2, FIG. 2A, FIG. 3, FIG. 4 and FIG. 5, in order to have the support strap system 116/118 be offset from a center of the convertible picnic basket 100 for creating more usable sitting area without having to sit on the support strap system, the strap support system may be offset from a center of the mat when in an unfolded configuration but centered in a folded configuration when configured as a basket. This is because sitting on the support strap system 116/118 may be uncomfortable. When configured as a basket, in a folded configuration, the straps may be centered between the first pocket 106*a* and the second pocket 106*d* by folding the column 110 that is three columns from the first edge column 102 and two columns from the second edge column 114 over the column 104 next to a first edge column.

Figure 2:
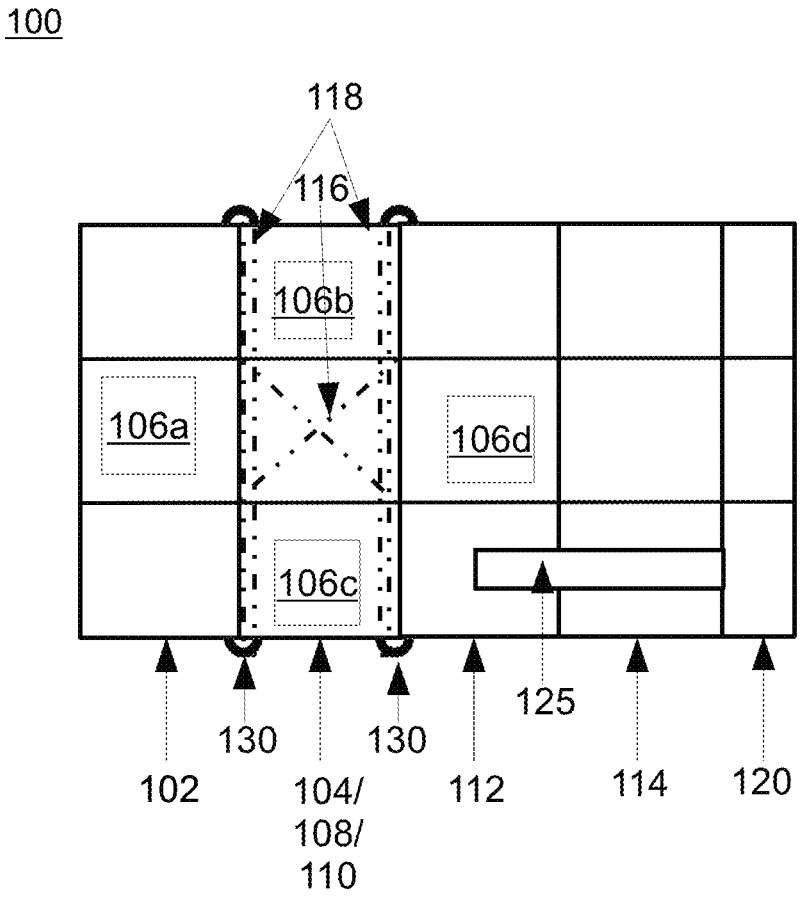
FIG. 2 illustrates a convertible picnic basket in accordance with some embodiments.
Figure 2A:
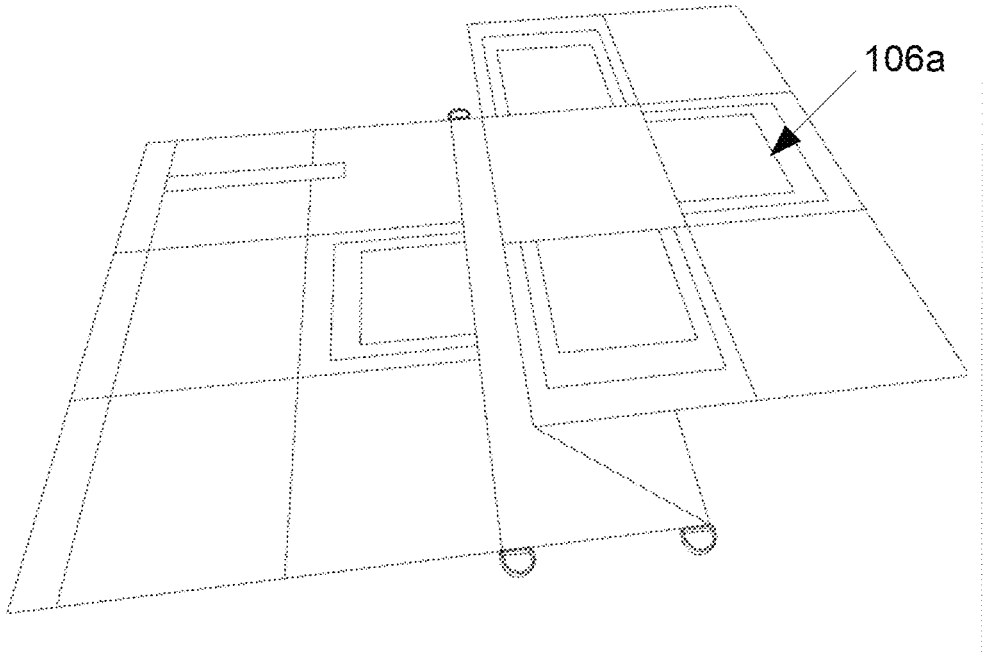
FIG. 2A illustrates a convertible picnic basket in accordance with some embodiments.

This fold, in a shape of a Z is referred to as a Z fold and this is illustrated in FIG. 2 and FIG. 2A. The effect of the Z fold is to create a thicker bottom of the convertible picnic basket 100 by stacking column 108 and column 110 over column 104 as shown in FIG. 2.

Figure 3:
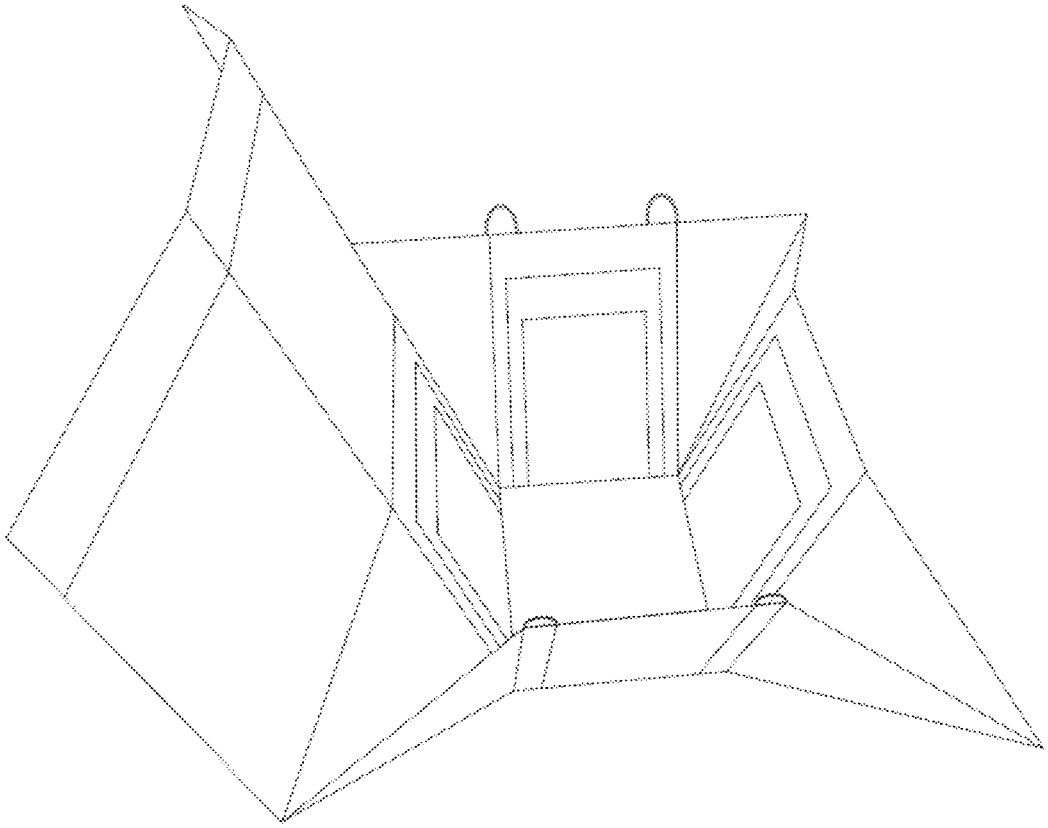
FIG. 3 illustrates a convertible picnic basket in accordance with some embodiments.
Figure 4:
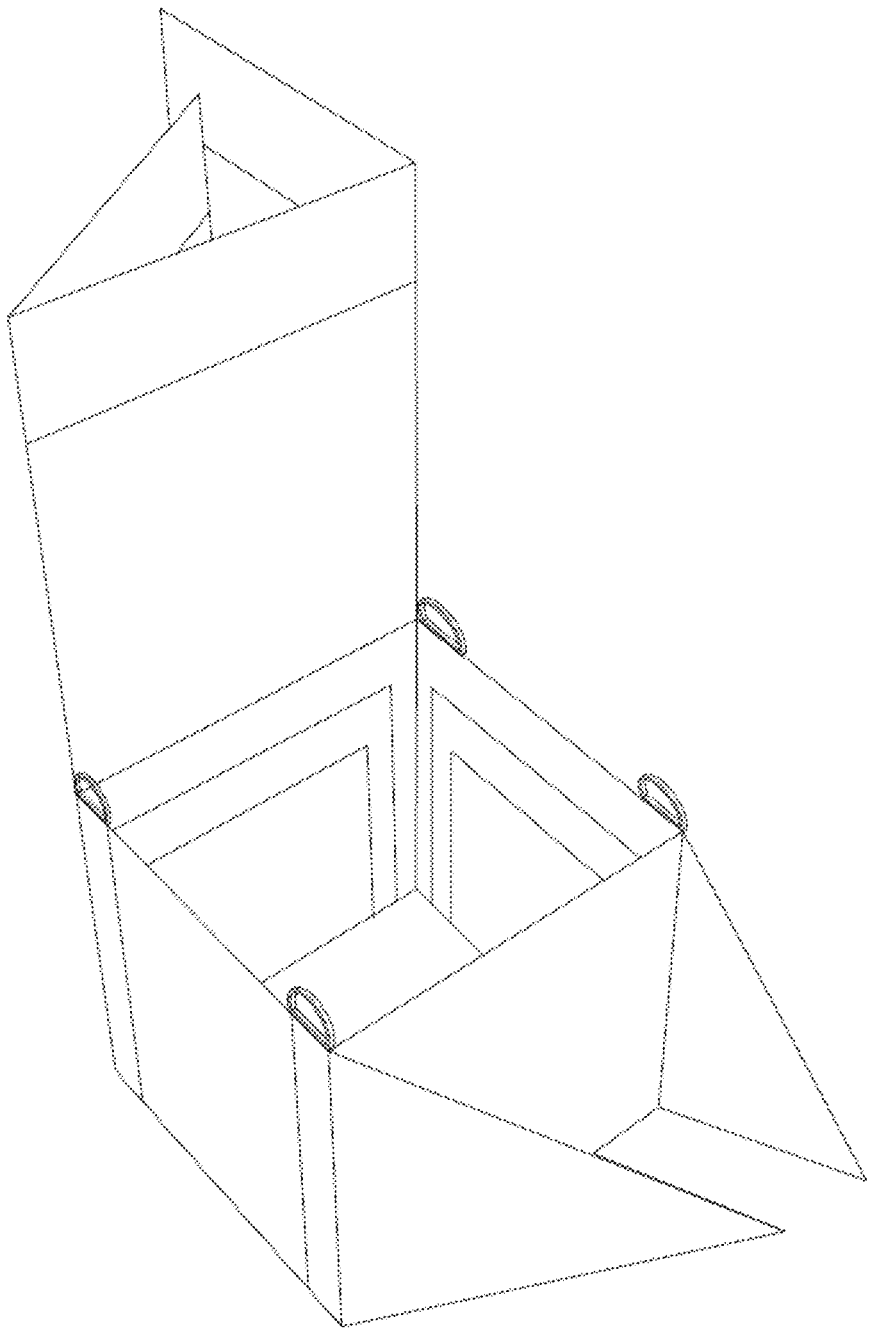
FIG. 4 illustrates a convertible picnic basket in accordance with some embodiments.

Once the Z fold is made, the sides of the convertible picnic basket 100 may be folded toward a center of the basket with the pockets 106*a*/106*b*/106*c*/106*d* oriented around a center panel of the convertible picnic basket 100 which is over the support strap system 116/118. This is illustrated in FIG. 2, FIG. 3 and FIG. 4. A portion of the mat that functions as a lid may be folded over a top opening in the basket after the sides of the convertible picnic basket 100 are formed (thus creating the opening).

Figure 5:
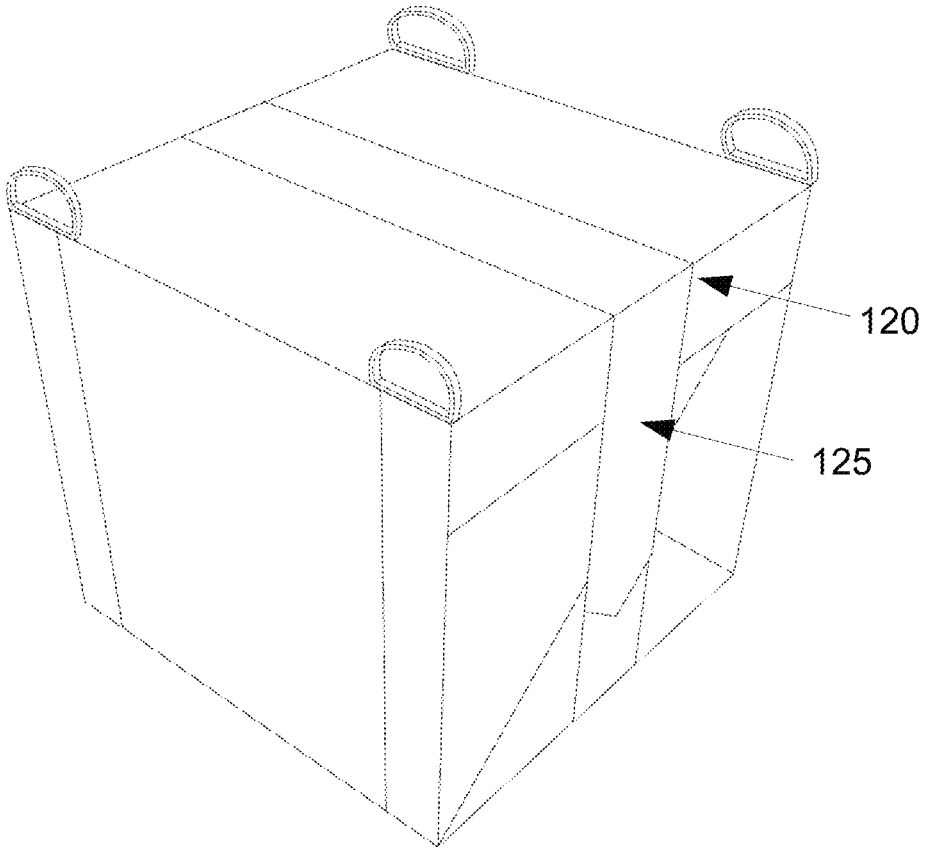
FIG. 5 illustrates a convertible picnic basket in accordance with some embodiments.

As illustrated in FIG. 4, to cover the picnic basket, the lid is employed where the second edge column functions 114 as the lid for the basket. In some embodiments, a handle may be attached to a center panel of the second edge column 114. As shown in FIG. 5, the convertible picnic basket 100 is in the folded configuration and forms a cube.

This written description uses examples to disclose multiple embodiments, including the preferred embodiments, and to enable any person skilled in the art to practice the invention, including making and using any devices or systems and performing any incorporated methods. Aspects from the various embodiments described, as well as other known equivalents for each such aspects, can be mixed and matched by one of ordinary skill in the art to construct additional embodiments and techniques in accordance with principles of this application.

Those in the art will appreciate that various adaptations and modifications of the above-described embodiments can be configured without departing from the scope and spirit of the claims. Therefore, it is to be understood that the claims may be practiced other than as specifically described herein.

What is claimed:

1. A basket that converts to a picnic mat, comprising:

a planar material which, in an unfolded mat configuration, comprises 18 equally sized panels arranged into a six-column by three-row format; wherein the six columns comprise a first edge column at one end and a second edge column at a distal end;

a column comprising a support strap system adjacent to the first edge column; and a stacking column adjacent the column comprising a support strap system, wherein the stacking column is configured to be folded over and lie on top of the column comprising the support strap system.

2. The basket of claim 1, wherein a column adjacent to the stacking column comprises two pockets.

3. The basket of claim 1, wherein the first edge column comprises a pocket.

4. The basket of claim 1, wherein a column adjacent to the second edge column comprises a pocket.

5. The basket of claim 1, wherein lid panels are disposed adjacent to the second edge column.

* * * * *